United States Patent [19]

Goldsmith

[11] 4,305,466

[45] Dec. 15, 1981

[54] OFFSHORE PLATFORM HAVING THREE DECKS

[75] Inventor: Riley G. Goldsmith, Houston, Tex.

[73] Assignee: Conoco Inc., Ponca City, Okla.

[21] Appl. No.: 146,567

[22] Filed: May 5, 1980

[51] Int. Cl.[3] ..... B63B 35/44; E21B 43/01; E21B 7/128

[52] U.S. Cl. ..... 166/381; 405/203

[58] Field of Search ..... 175/7–9; 405/195, 203, 205; 114/264, 265; 166/315

[56] References Cited

U.S. PATENT DOCUMENTS

| | | | |
|---|---|---|---|
| 2,808,230 | 10/1957 | McNeill et al. | 175/7 |
| 2,908,141 | 10/1959 | Marsh, Jr. | 405/205 X |
| 3,355,899 | 12/1967 | Koonce et al. . | |
| 3,451,493 | 6/1969 | Storm | 175/9 |
| 3,648,638 | 3/1972 | Blenkarn . | |
| 3,916,632 | 11/1975 | Thomas | 175/7 X |
| 4,142,584 | 3/1979 | Brewer et al. . | |

*Primary Examiner*—Stephen J. Novosad
*Attorney, Agent, or Firm*—A. Joe Reinert

[57] ABSTRACT

An improved offshore platform, the platform including three decks in the wellbay area; a first lower deck adapted to provide a workspace for the positioning of equipment to be lowered to the ocean floor, a second middle deck, said middle deck being the main production deck from which production conduits from said wellbores are supported and from which production operations are conducted after completion of said wellbores and a third upper deck said third deck being adapted to support drilling, completion and workover equipment and to provide a protective barrier between said equipment and said second deck.

9 Claims, 4 Drawing Figures

OFFSHORE PLATFORM HAVING THREE DECKS

This invention relates to the use of offshore platforms for the drilling of wellbores to reach subterranean formations and the production of fluids from such formations.

This invention further relates to an improved method for constructing an offshore platform to facilitate the drilling of wellbores and the production of fluids therefrom.

In recent years, the continuing worldwide shortage of petroleum products and the increasing demand for such products with the resulting increasing prices for such products has resulted in continued efforts to produce petroleum from subterranean formations located in increasingly difficult environments. One such area of endeavor is a continuing effort to produce crude oil from subterranean formations lying at ever increasing depths beneath the world's oceans. As is well-known to the art, crude oil has been produced from oil bearing subterranean formations in relatively shallow ocean water for many years and in recent years large deposits have been discovered in ocean water which is of a depth such that the use of conventional types of offshore platforms is less suitable and considerably more expensive. One approach used to overcome the difficulties of using conventional offshore platforms supported from the ocean bottom by rigid support members has been the development of a type of platform generally referred to as a tension leg platform. Such platforms generally comprise a floating platform which includes a buoyancy section for supporting the working level of the platform by the buoyancy of the platform as a whole with the platform being positioned over foundations positioned on the ocean floor at a desired site and thereafter secured to the foundations by tensioning elements which are placed in tension to hold the tension leg platform in position at a level in the water such that the platform does not move vertically with wave action and the like. While some slight vertical movement may occur due to stretching or contraction of the tensioners, the tensioners are always in tension so that the platform does not tend to move vertically with wave action and the like. As a result, a relatively stable platform is provided for use in drilling wells in the ocean floor and producing fluids therefrom. The use of such platforms is considered to be highly desirable in waters which are beyond the depths normally considered suitable for the use of conventional platforms.

It has been found that in accordance with the present invention the wellbay area of offshore platforms desirably comprises three decks. A lower deck is provided and is adapted to provide a workspace for positioning equipment to be lowered to the ocean floor with a middle deck being provided and adapted to function as the main production deck from which the risers from the wellbores are supported and from which production operations are conducted after completion of the wellbores and an upper deck being provided and adapted to support drilling, completion and workover equipment and to provide a protective barrier between such equipment and the second deck.

In the description of the Figures, the same numbers will be used throughout to refer to the same or similar elements.

Figure 1:
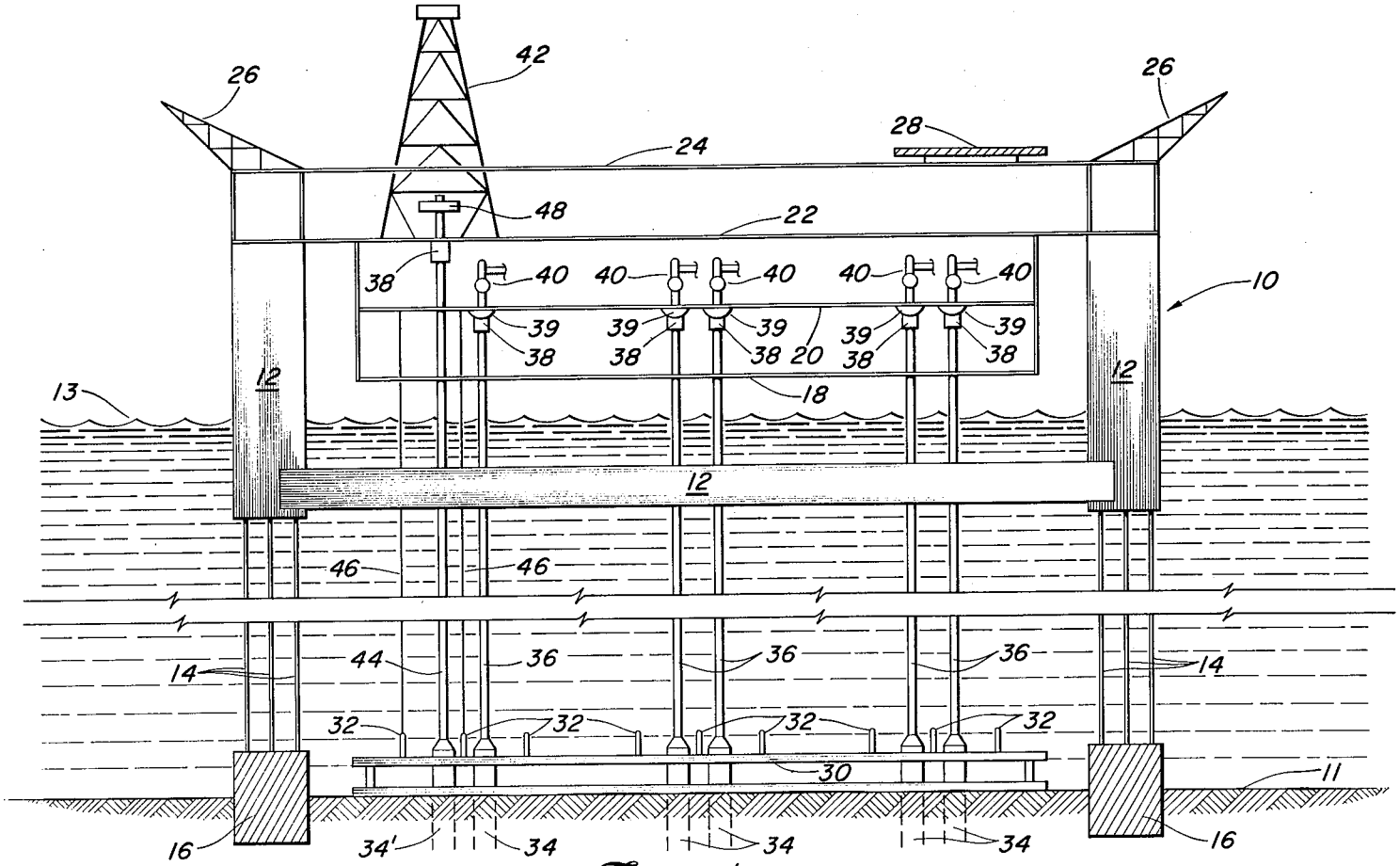
FIG. 1 is a schematic drawing of a tension leg platform.

In FIG. 1 a tension leg platform 10 is shown. Tension leg platform 10 comprises buoyancy members 12 positioned by tensioning elements 14 at a suitable depth in an ocean 13 with tensioning elements 14 being attached to a foundation 16 and adjusted to maintain a suitable tension in tensioning members 14 to maintain tension leg platform 10 at a desired level in ocean 13. Foundation 16 is positioned on the ocean floor 11 and is of a suitable construction to provide sufficient anchorage to maintain tension leg platform 10 in a desired position. In the practice of the present invention, the wellbay area of tension leg platform 10 is desirably constructed having a first deck 18, a second deck 20 and a third deck 22. First deck 18 is adapted to provide a workspace for the positioning of guidewires which are typically fastened to the lower side of second deck 20 and for positioning equipment and the like to be lowered to the ocean floor. Second deck 20 contains production wellheads and the facilities normally used in the production of fluids from subterranean formations. Third deck 22 is adapted to the operation of drilling and workover equipment, maintenance operations and the like and shelters second deck 20 from the drilling, workover and maintenance operations. Further structural support members 24 are shown supporting a drilling tower 42 and a helicopter pad 28. Derricks 26 are optionally positioned on the outer edges of tension leg platform 10 to facilitate the loading and unloading of equipment and the like as known to the art. On ocean floor 11, a template 30 is positioned beneath platform 10 to facilitate the positioning of a plurality of wells 34. Template 30 is typically of a tubular construction and is conveniently floated to the desired location and then sunk with suitable means being provided for levelling template 30 and the like as known to the art. Further, template 30 is normally fastened in position by connection to the platform supports, the use of pilings (not shown) and the like as known to the art. Template 30 comprises a grid or the like structure for use in positioning wells 34. Guideposts 32 are positioned at appropriate locations on template 30 to facilitate the use of guideframes and the like in conjunction with guidewires 46 shown in conjunction with one of the wellbores 34'. The wells as shown are all complete and equipped with production risers except for one well 34' which is being drilled from a drill tower 42. Production risers 36 terminate at production wellheads 40 from which fluids are passed to crude oil storage, sales or the like. The transportation of such fluids is known to the art and will not be discussed in detail. Production risers 36 are suitably maintained in tension by a tensioners 38 positioned on the bottom of second deck 20. Desirably, tensioners 38 are used in conjunction with rotatable supports 39 which rotatably maintain production risers 36 in position. In the case of the well being drilled, (well 34') a blowout preventer 48 is shown near the top of a drilling riser 44 with a tensioner 38 being shown operatively positioned in contact with drilling riser 44 beneath third deck 22.

Figure 2:
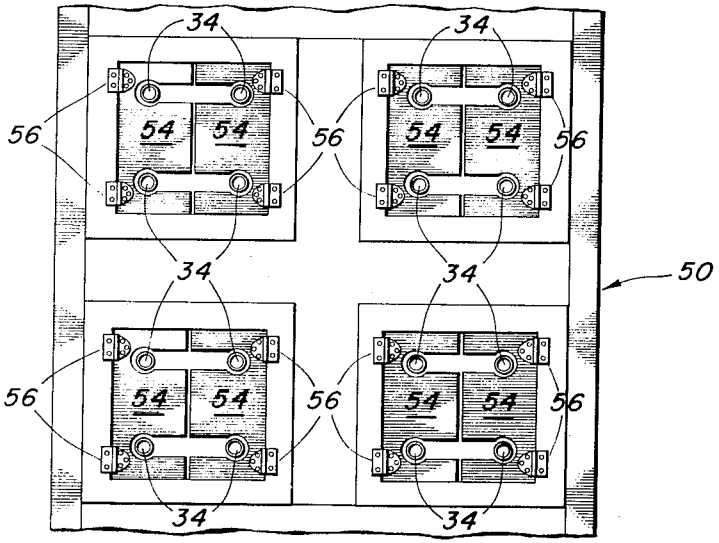
FIG. 2 is a top view of a portion of the lower deck of the tension leg platform shown in FIG. 1.

In FIG. 2, a section 50 of the floor of first deck 18 is shown. Wells 34 are positioned through openings as shown. Wells 34 are positioned in clusters of four with each of the wells being positioned at a corner of a quadrangle formed by the four wells and doors 54 are provided in connection with each set of four wells so that doors 54 which are mounted on hinges 56 are readily opened downwardly to permit the passage of guideframes, and the like downwardly along the guidewires to ocean floor 11. The advantages of spacing wells 34 in groups of four are apparent upon observing that considerable working space is available around each grouping of four wells for normal operations. It has been found that the use of clusters of four wells as shown in FIG. 2 is highly beneficial in providing for efficiency of operation particularly with respect to the use of drilling and maintenance tools and the like which are passed downwardly to the ocean floor.

Figure 3:
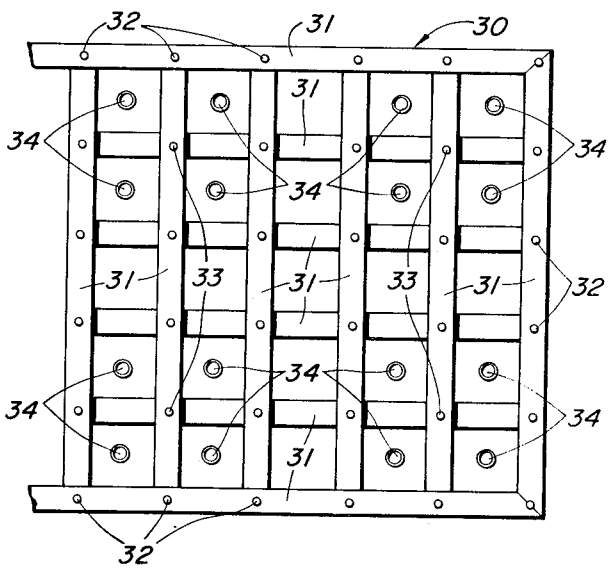
FIG. 3 is a top view of a portion of the template shown in FIG. 1.

In FIG. 3 a top view of a section of template 30 is shown. Wells 34 are shown positioned between tubular sections 31 of template 30. Guideposts 32, only a portion of which have been numbered for simplicity, are shown with center guideposts 33 being provided in each grouping of four wells to facilitate the use of guidewires 46 positioned on guideposts 32. It is clear that one guidewire is common to each group of guidewires used with a given well.

Figure 4:
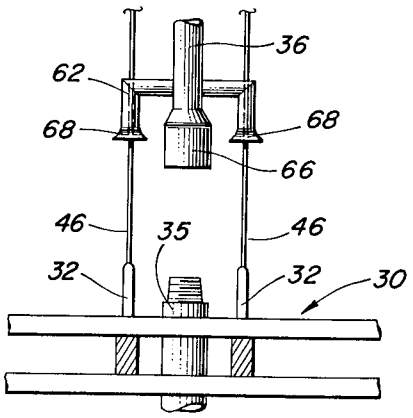
FIG. 4 shows the use of a guideframe in conjunction with guidewires to position a fitting on a wellbore.

In FIG. 4 guidewires 46 are shown in conjunction with a guideframe 62 which is used to guide a production riser 36 with a fitting 66 positioned on its lower end to union with a wellhead 35. Guideframe 62 includes a pair of flared members 68 suitable for mating with guideposts 32 to accurately position guideframe 62 and the tooling or the like contained in guideframe 62 with reference to wellhead 35. Normally flared ends or cone-like extensions of members 68 are provided to facilitate mating union of guideframe 62 and guideposts 32.

In a normal offshore platform drilling practice, a large casing such as a 30" O.D. (outer diameter) casing is used to case the borehole to a depth of about 100 to about 300 feet with the 30-inch O.D. casing typically being set in about a 36-inch borehole and cemented in place. In the present discussion uncased holes are referred to as boreholes with cased boreholes being referred to as wellbores. The borehole is then extended to a greater depth using a 20" O.D. casing which is cemented into a 26" borehole which is readily drilled through the 30" O.D. casing to a depth of from about 1000 to about 1500 feet below the mud line, i.e. ocean floor. Further extensions of the wellbore to a depth from about 2000 to about 6000 feet are accomplished by the use of a 13-$\frac{3}{8}$" O.D. casing which is cemented in a borehole roughly 17-$\frac{1}{2}$" in diameter which is readilly drilled through the 20" O.D. casing. The further completion of the wellbore to the production zone, and if desired, through the production zone is achieved by positioning a 9-$\frac{5}{8}$" O.D. casing in a 12-$\frac{1}{4}$" diameter extension of the borehole drilled through the 13-$\frac{3}{8}$" O.D. casing and then cementing the 9-$\frac{5}{8}$" O.D. casing in place. In some instances a 7' O.D. liner is run to greater depths with the liner being positioned in an 8-$\frac{1}{2}$" diameter borehole drilled through the 9-$\frac{5}{8}$" O.D. casing. While the depths set forth are illustrative in nature and the sizes set forth are those typically used considerable variation in the size, number and lengths of casing used is possible. In the use of surface drilling techniques from the platform as practiced heretofore, a large diameter, i.e. 30" O.D. or larger conduit would be extended from the platform to the ocean floor and optionally driven some distance into the ocean floor with subsequent drilling operations being conducted through the conduit with all the casing strings except the 7" liner positioned at the bottom of the borehole extending upwardly to the platform working level. In other words, all the casing strings extend all the way to the surface and the blowout preventer and the like are normally positioned at the surface in such applications. By contast, drilling from drill ships and the like normally would result in the use of a hanger or wellhead at the mud line to support the casing strings with the blowout preventer etc. being positioned at the mud line.

In a preferred drilling method for use with tension leg platforms, a borehole is drilled without casing to a depth sufficient to permit circulation of drilling fluids etc. after cementing a casing in the borehole. The casing normally used is a relatively large casing typically about a 30" O.D. casing. This casing terminates at a wellhead or casing hanger near the mud line and is normally cemented in place and thereafter a smaller casing string is run into a further smaller diameter extension of the borehole. Applicant uses surface drilling techniques as described above but hangs the casings from a wellhead or casing hanger near the mud line with all the casings ending near the mud line. A drilling riser is positioned to fluidly communicate the drilling operations on platform 10 and the wellhead or casing Wellheads and casing hangers suitable for hanging casing strings are well-known to the art and need not be discussed in detail except to note that a casing hanger is normally sufficient unless additional functions are required. The drilling riser used can be of any suitable size although in most instances it is anticipated that a 20" O.D. drilling riser will be used. Drilling riser 44 is a high pressure riser and desirably contains high pressure flexible joints which will permit movement of tension leg platform 10 without the imposition of undue stresses on drilling riser 44. Upon completion of the well, drilling riser 44 is disconnected and production riser 36 which is desirably of a smaller size, typically about a 9-$\frac{5}{8}$" outer diameter riser is positioned to fluidly communicate wellhead 35 and production header 40 at platform 10. The tubing used for the production of fluids is then positioned as known to the art through the production riser and the casing to a selected depth. Production riser 36 must be able to accommodate some horizontal movement of tension leg platform 10. Production riser 36 must also be capable of containing fluids from the formation etc. should the production tubing rupture or otherwise fail. As known to the art, smaller diameter pipes ae preferable for such purposes. While the use of the drilling method set forth above is preferred with tension leg platforms it is applicable to platforms other than tension leg platforms. The requirement for flexibility in drilling riser 44 and production riser 36 is greater with tension leg platforms or other movable platforms such as drill ships or the like. Advantages are achieved even with conventional platforms by the use of the drilling technique as discussed above such as the saving of a large quantity of steel required for the conduits and casing extensions from the ocean floor to the platform deck as used in the past. The use of this method as it relates to the production of fluids from the wellbores results in further advantages even when rigidly fixed platforms are used. In particular, the use of a smaller pipe as a production riser results in less resistance to waves, currents and the like which results in the ability to design the platforms to withstand less stress since a smaller pipe is exposed to the wave and current action. In the use of tension leg platforms such considerations are even more important because of the desire to minimize horizontal motion in response to wave and currents. In the use of the production risers as discussed above with tension leg platforms, it has been found desirable in order to minimize stresses in the production risers that the production risers be maintained under tension by the use of tensioners 38 in conjunction with each of the production risers. Suitable tensioners are considered to be well-known to those skilled in the art as shown for instance in U.S. Pat. No. 4,142,584 issued Mar. 6, 1979. When tension leg platforms or other movable platforms are used, it is desirable that a rotatable mounting be used for supporting the production risers in second deck 20. While it is not necessary that a considerable amount of rotational motion be permitted it is clear that in tension leg platforms as shown in FIG. 1, the tensioning elements are of a different length than the production risers, therefore different motions occur at the top of the production risers and at the top of the tensioning elements as tension leg platform 10 shifts as a result of wind and current action. As a result, it is highly desirable that both the tensioning means and rotatable mounting means be used to position the production risers at their upper ends in operative association with platform 10.

In drilling from conventional offshore platforms, an alternate drilling method is preferred. In the alternate drilling method the well is drilled as discussed above with all the casing strings extending to the platform, but with mudline suspension equipment being positioned near the mudline (ocean floor) so that upon completion of the drilling and casing operations the casing strings can be disconnected at the mudline suspension equipment and removed with a production riser then being positioned to fluidly communicate the platform and the casing. The production tubing is then positioned through the production riser. The advantages achieved by the preferred method for tension leg platforms are accomplished with conventional platforms by the present method, but without the need for a high pressure flexible drilling riser. It is desirable with the present method to rotatably support the upper ends of the production risers at the platform in tension to accommodate motion at the top of the production risers due to currents, waves etc.

Further, it is desirable that the lower portions of production risers 36 be tapered to prevent the generation of undue stress at or near the union of the production risers and the wellheads casing hangers etc. Such tapering is highly desirable with platforms such as tension leg platforms. The amount of tapering provided is readily determined by those skilled in the art and is desirably selected to distribute anticipated bending stresses along the bottom twenty percent or less of the length of the production riser.

The use of three decks as the platform work area is considered to be particularly advantageous with all types of offshore platforms especially when methods such as those discussed above are used. The first deck is particularly adapted to provide a work space for operations such as the maintenance and replacement of guidewires etc. which are normally fastened to the lower portion of second deck 20 and for the positioning of guideframes and other equipment to be lowered to the ocean floor. Second deck 20 is adapted to the production of fluids from the wells and the operation of the normal production equipment used for the production of oil from subterranean formations. Third deck 22 is adapted to the support of drilling, completion and workover equipment and also provides a protective barrier between such equipment and the second deck. Such facilitates uninterrupted production operations when drilling or workover operations are in progress even though relatively large equipment which might otherwise constitute a hazard to operating personnel as a result of the limited space available on such platforms is used. The combination of features discussed herein results in an improved efficiency in drilling wells from offshore platforms and the production of fluids therefrom.

Having described the invention by reference to certain of its preferred embodiments it is respectfully pointed out that the embodiments described herein are illustrative rather than limiting in nature and that many variations and modifications are possible within the scope of the present invention.

Having thus described the invention, I claim:

1. An offshore production system, comprising:

an offshore platform including an upper deck, a middle deck, and a lower deck;

at least one wellbore disposed through an ocean floor and penetrating a subterranean formation;

at least one production riser connecting said wellbore with said platform, said production riser having an upper end supported from said middle deck and having production equipment connected to said upper end adjacent said middle deck so that production operations may be conducted from said middle deck;

drilling equipment located on said upper deck for drilling said wellbore and performing completion and workover operations thereon;

wherein said upper deck provides a protective barrier between said drilling equipment and said middle deck; and wherein said lower deck includes a workspace for the positioning of equipment to be lowered to the ocean floor.

2. The production system of claim 1, wherein;

said lower deck includes doors positioned about said riser, said doors being openable to permit the lowering of equipment to the ocean floor at said wellbore.

3. The production system of claim 2, wherein;

said doors include an opening disposed therethrough through which said riser is received.

4. The production system of claim 2, wherein:

said workspace is located adjacent each of said doors.

5. The production system of claim 1, wherein:

said system includes a plurality of wellbores; and said wellbores are arranged in groups of four wellbores, each of said wellbores being positioned at a corner of a quadrangle formed by said four wellbores.

6. The production system of claim 1, wherein:

said wellbore includes a casing terminating near said ocean floor; and said production riser is positioned between said casing of said wellbore and said platform to provide fluid communication therebetween.

7. The production system of claim 1, wherein:

said platform is a tension leg platform.

8. The production system of claim 7, wherein:

said upper end of said production riser is rotatably supported in tension from said middle deck.

9. The production system of claim 1, wherein:

said upper end of said production riser to rotatably supported in tension from said middle deck.

* * * * *